US009556670B2

(12) United States Patent
Farntrog

(10) Patent No.: US 9,556,670 B2
(45) Date of Patent: Jan. 31, 2017

(54) MULTI-FUNCTION RETRACTABLE WINDOW SCREEN

(71) Applicant: Eric Farntrog, Lakewood, NJ (US)

(72) Inventor: Eric Farntrog, Lakewood, NJ (US)

( * ) Notice: Subject to any disclaimer, the term of this patent is extended or adjusted under 35 U.S.C. 154(b) by 0 days.

(21) Appl. No.: 14/200,391

(22) Filed: Mar. 7, 2014

(65) Prior Publication Data

US 2014/0251553 A1 Sep. 11, 2014

Related U.S. Application Data

(60) Provisional application No. 61/774,294, filed on Mar. 7, 2013.

(51) Int. Cl.

| | |
|---|---|
| ***E06B 9/58*** | (2006.01) |
| ***E06B 9/52*** | (2006.01) |
| *E06B 9/08* | (2006.01) |
| *E06B 9/40* | (2006.01) |
| *E06B 9/54* | (2006.01) |

(52) U.S. Cl.

CPC .. *E06B 9/52* (2013.01); *E06B 9/08* (2013.01); *E06B 9/40* (2013.01); *E06B 9/58* (2013.01); *E06B 2009/528* (2013.01); *E06B 2009/543* (2013.01)

(58) Field of Classification Search

CPC ..... E06B 2009/527; E06B 2009/528; E06B 2009/587; E06B 2009/588; E06B 2009/1577; E06B 9/52; E06B 9/58

USPC ..... 160/24, 27, 28, 30, 31, 41, 99, 100

See application file for complete search history.

(56) References Cited

U.S. PATENT DOCUMENTS

| | | | | | |
|---|---|---|---|---|---|
| 1,191,012 | A | * | 7/1916 | McEwen | 160/275 |
| 1,216,794 | A | * | 2/1917 | Garman | 160/31 |
| 1,795,087 | A | * | 3/1931 | Higgins | 160/21 |
| 2,012,124 | A | * | 8/1935 | Feige | 160/30 |
| 2,491,555 | A | * | 12/1949 | Fistor | 160/30 |
| 2,575,128 | A | * | 11/1951 | Renzetti | 160/28 |
| 2,584,369 | A | * | 2/1952 | Renton | 160/28 |
| 2,825,400 | A | * | 3/1958 | Poulsen | 160/30 |
| 3,552,471 | A | * | 1/1971 | Hurst et al. | 160/27 |
| 4,821,786 | A | * | 4/1989 | Johnston | 160/23.1 |
| 4,934,437 | A | * | 6/1990 | Kraeutler | 160/84.02 |
| 6,035,460 | A | * | 3/2000 | Borter | 4/607 |
| 6,039,107 | A | * | 3/2000 | Pittard | 160/370.22 |
| 6,098,698 | A | * | 8/2000 | King-Darr | 160/290.1 |

(Continued)

*Primary Examiner* — David Purol

(74) *Attorney, Agent, or Firm* — Israel Nissenbaum; Yitzy Nissenbaum

(57) ABSTRACT

A retractable screen structure to cover opening of windows. The structure has a first housing member with a coiled screen mesh therewithin. A second elongated housing member is engaged with an end of the screen mesh extending out of the first housing member. The second housing member has a releasable locking element and is parallel to the first housing member. A cooperative releasable locking element positioned on the window or window frame, is configured to cooperate with the releasable locking element of the second housing member to effect a releasable locking h, The coiled screen mesh substantially covers the opening when uncoiled and is connected to a retracting/extending mechanism contained within the first housing which allows the end of the screen mesh be drawn through an opening in the first housing and uncoiled to substantially cover the opening and to retract the screen mesh when desired.

15 Claims, 14 Drawing Sheets

(56) References Cited

U.S. PATENT DOCUMENTS

Figure 1:
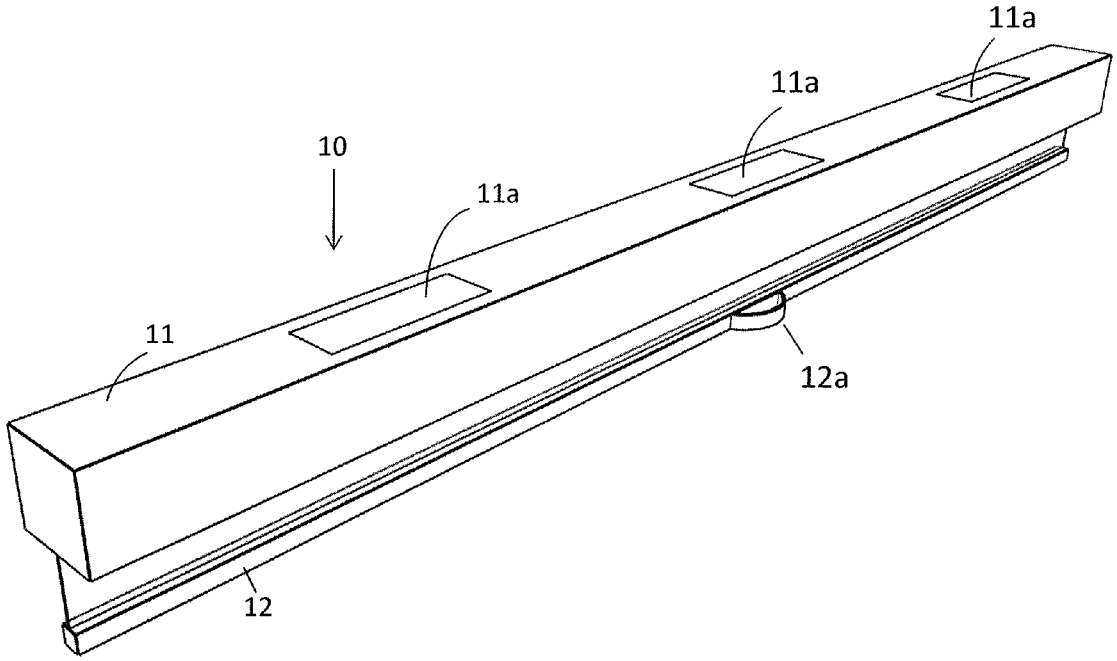

| | | | | |
|---|---|---|---|---|
| 7,080,676 | B2 * | 7/2006 | Abelson et al. | 160/30 |
| 7,331,369 | B2 * | 2/2008 | Cordova | 160/23.1 |
| 7,861,761 | B2 * | 1/2011 | Martineau et al. | 160/31 |

* cited by examiner

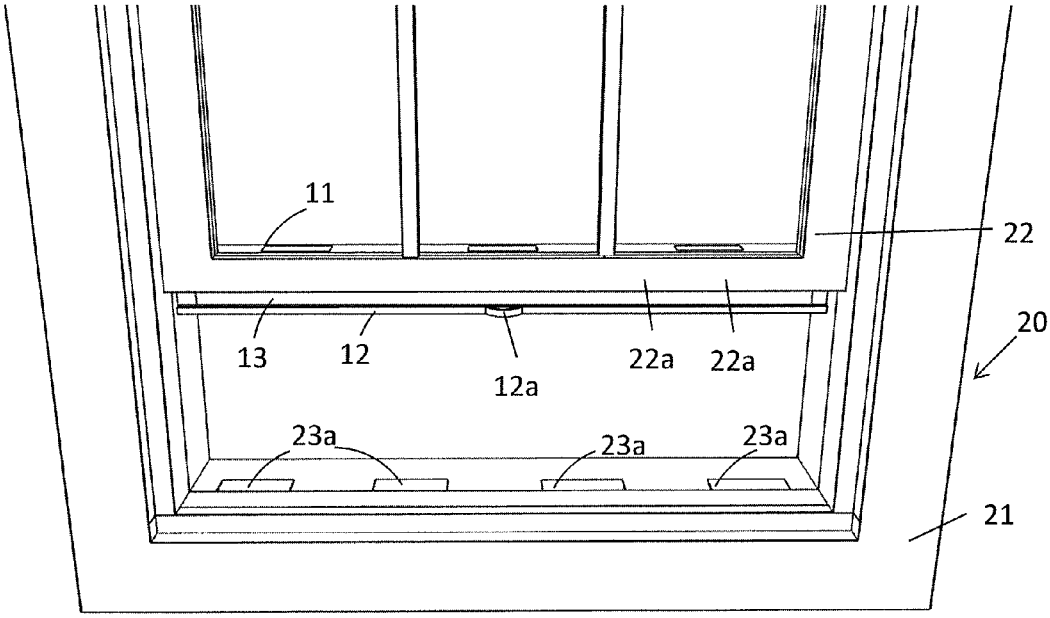
FIG. 3
FIG. 4
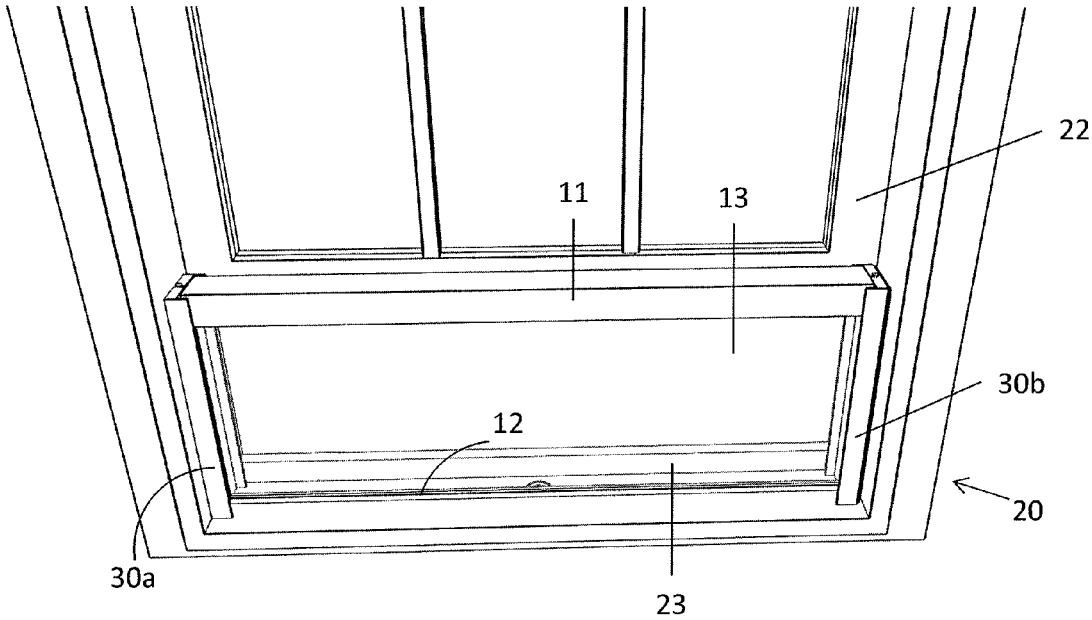

FIG. 10A
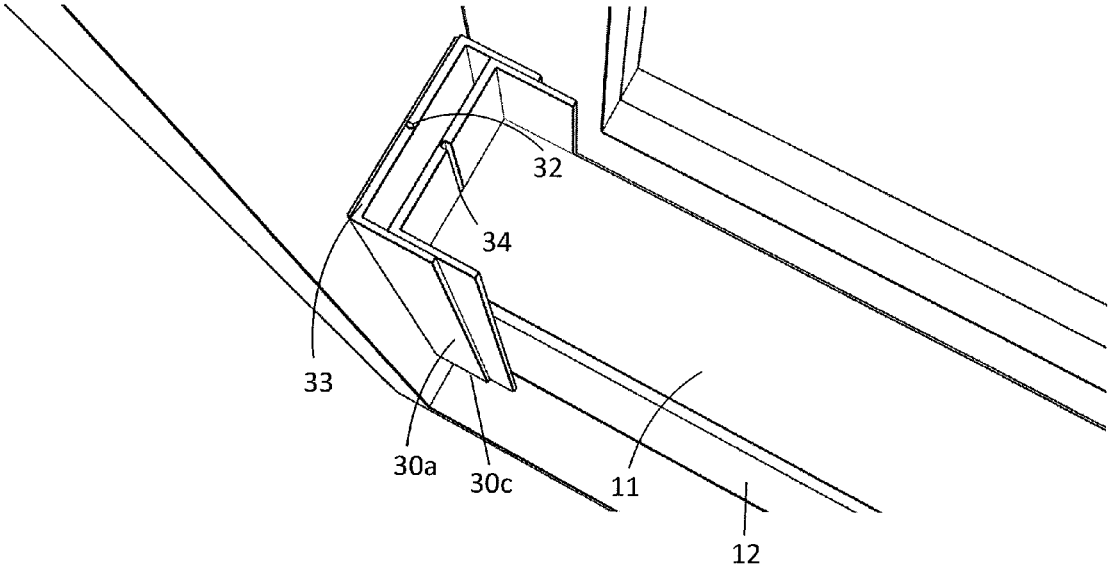
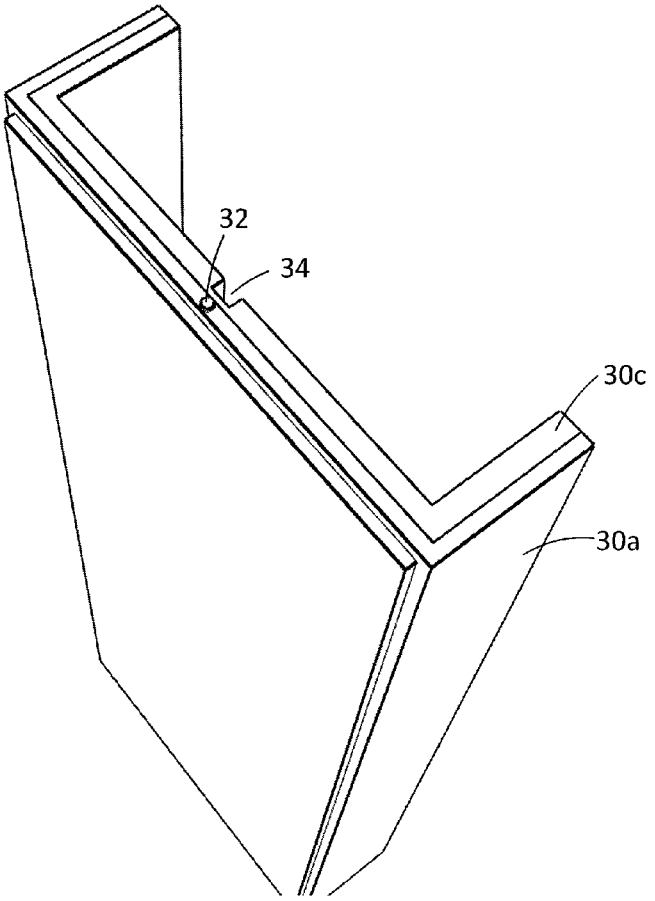
FIG.10B

MULTI-FUNCTION RETRACTABLE WINDOW SCREEN

FIELD OF THE INVENTION

This invention relates to retractable screens and particularly to retractable screens adapted to be fitted and selectively placed and removed from use with specific windows and to readily deployed screens integrated with existing window hardware and elements.

BACKGROUND

Window and door screens exist in several forms. A first and common one is that of a fixed screen either positioned on or adjacent a window or door with a second type being a screen used situated in its own track which is adapted to be drawn over an opening when a window or door, such as a patio door, is opened.

Recently retractable screens have become available, with the screen being built into a special housing separate from the window or door with such screens being drawn across the window or door openings and then retracted when not in use. The retractable screens however are however, fixed into position, are custom made for the particular door and window with an extensive and costly operational separate infrastructure. They cannot be used, as desired with different doors or windows.

SUMMARY OF THE INVENTION

It is an object of the present invention to provide a first embodiment of economical retractable screen structures suitable for use with openings such as with windows or doors respectively and which are unobtrusive and removable for use with different windows or doors respectively.

It is a further object of the present invention in which the removable retractable screen structures further comprise size adjustable elements, which permit them to be appropriately used with windows and doors respectively of different sizes and configurations.

It is yet another object of the present invention to provide a second embodiment of the retractable screen structures of the present invention wherein the retractable screen elements are included directly within the window or door structures as integrated operational elements with opening of the door or window serving to automatically draw a screen into position, as desired.

Generally the present invention comprises a retractable screen structure with a screen element rolled up and contained within a first horizontally slotted elongated housing member and maintained therein with a retractable spring element, such as contained within window shade bars. Screens suitable for use in the present invention are of structural integrity to permit repeated rolling motions and to resist outside conditions such as winds or rain. The screens are preferably comprised of strengthened plastic mesh or non-corroding metal mesh. The spring structure allows for extension of the retractable screen element through the horizontal slot and outwardly thereof over a required distance and the smooth retraction thereof. A distal end of the retractable screen element is fixedly held by a retaining element or is fixedly held and contained within a second housing member (hereinafter the term "second housing member" includes a simple "retaining element"). The retractable screen structure further comprises a locking member, which engages the second housing member when the retractable screen is fully extended to span an opening. The locking member comprises cooperative elements relative to the second housing member such as magnetic elements and hook and eye elements, commonly referred with the trademark Velcro (as used hereinafter for convenience), which are removably lockingly engageable with elements of the second housing member to hold an extended screen element in a taut position such as against the retraction forces. A handle element is provided on the second housing member to enable a user to effect manual disengagement and screen retraction if desire.

The retractable screen structure is configured for spanning and substantially covering an opening in any one of a window and doorway, the structure comprising:

i) a first elongated housing member having a longitudinal axis, ii) a coiled expandable screen mesh element contained within the first housing member with an end thereof extending out of the first housing member;

iii) a second elongated housing member having a releasable position locking element and positioned substantially parallel to the first housing member and connected to the extended end of the screen mesh element, and iv) a cooperative releasable locking element positioned on one of a door and door frame or window and window frame, which is configured to cooperate with the releasable position locking element of the second elongated housing member to effect a releasable locking therewith, The coiled screen mesh element comprises an elongated coiled roll of sufficient width and length to span and substantially cover the opening when uncoiled and the coiled screen mesh element is connected to a retracting/extending mechanism contained within the first housing. The retracting/extending mechanism is configured to allow the end of the screen mesh element to be drawn through an opening in the first housing and uncoiled to substantially cover the opening and to retract the screen mesh element when desired.

The end of the screen mesh element extending through the opening is fixedly engaged with the second elongated housing member, and the first elongated housing is integrated with the other of the door and door frame or window and window frame. A screen covering of an opening is formed with extension of the screen mesh element to cover the opening.

The respective first and second housing members are configured such that one of the members is adapted to be fastened to a portion of the window sash or door, adjacent the opening formed when the window or door is opened. For example, with a typical double hung window, one of the housing members is fastened to either the upper part of the upper window sash or the lower part of the lower window sash depending on whether the upper sash is pulled down or the lower sash is pulled up to provide respective window openings. If the retractable screen element is to be used with different windows or doors, the fastening is a releasable one to enable the screen element to be removed from one window or door and fastened to another window or door, as desired.

In a preferred embodiment the first housing member is integrated (whether removably or fixedly) with the window sash and the second housing member is movable and configured to be positioned on, or adjacent the respective window sill or window head (or window side with a laterally opening window and lockingly held in position with releasable elements such as magnetic elements, hook and eye fasteners and the like, for screen deployment. Cooperative fastening elements are positioned in, on, or adjacent the sill or head of the window frame. For doors, the first and second housings are integrated with the door and frame for sliding doors, and with opposing doorframe sides for hinged doors.

Transferrable retractable screen elements, configured for use with different windows or doors, preferably further comprise elements, which enable them to be utilized with respective window and doors, which vary somewhat in dimension (up to about 2-3 inches in width variance). Such elements include lateral brush elements and/or expandable lateral tracks, which close any gaps between the extended screen and the window frame or door jambs.

In a second embodiment of the retractable screen structure, the housing elements are the actual window sash and/or frame elements or door and/or door jambs. The screen structure is specifically configured for the specific application and is not transferable to other windows or doors. The integrated non-removable retractable screen is therefore usually incorporated into the window or door by the manufacturer rather than the user, in contrast to the transferable embodiment. In this embodiment, the window manufacturer further optionally installs tracks into the sides of the window frame, and incorporates the retractable screen into the bottom, top or side of the window sash depending on the type of window. A locking mechanism is incorporated into the windowsill so that the retractable screen can slide down and be locked into place with a handle being provided to manually open the screen if desired. Built-in tracks on the side of the window are a preferable option since they provide increased durability for the window structure and screen elements.

An alternative structure, with a screen mechanism incorporated in the windowsill rather than in the window sash, is similarly operable. A locking system such as a magnetic system provides the window with the capability of the integrated screen being fastened to the window sash and automatically rolling with the motion of the window sash. A user is able to manually open the screen when so desired by disengaging the screen from the window sash.

Other objects, features and advantages of the present invention will become more evident from the following discussion and drawings in which:

SHORT DESCRIPTION OF THE DRAWINGS

Figure 2:
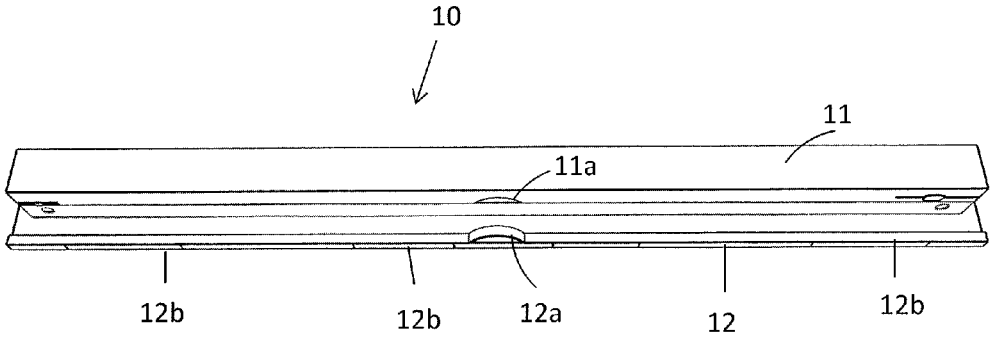
Figure 5:
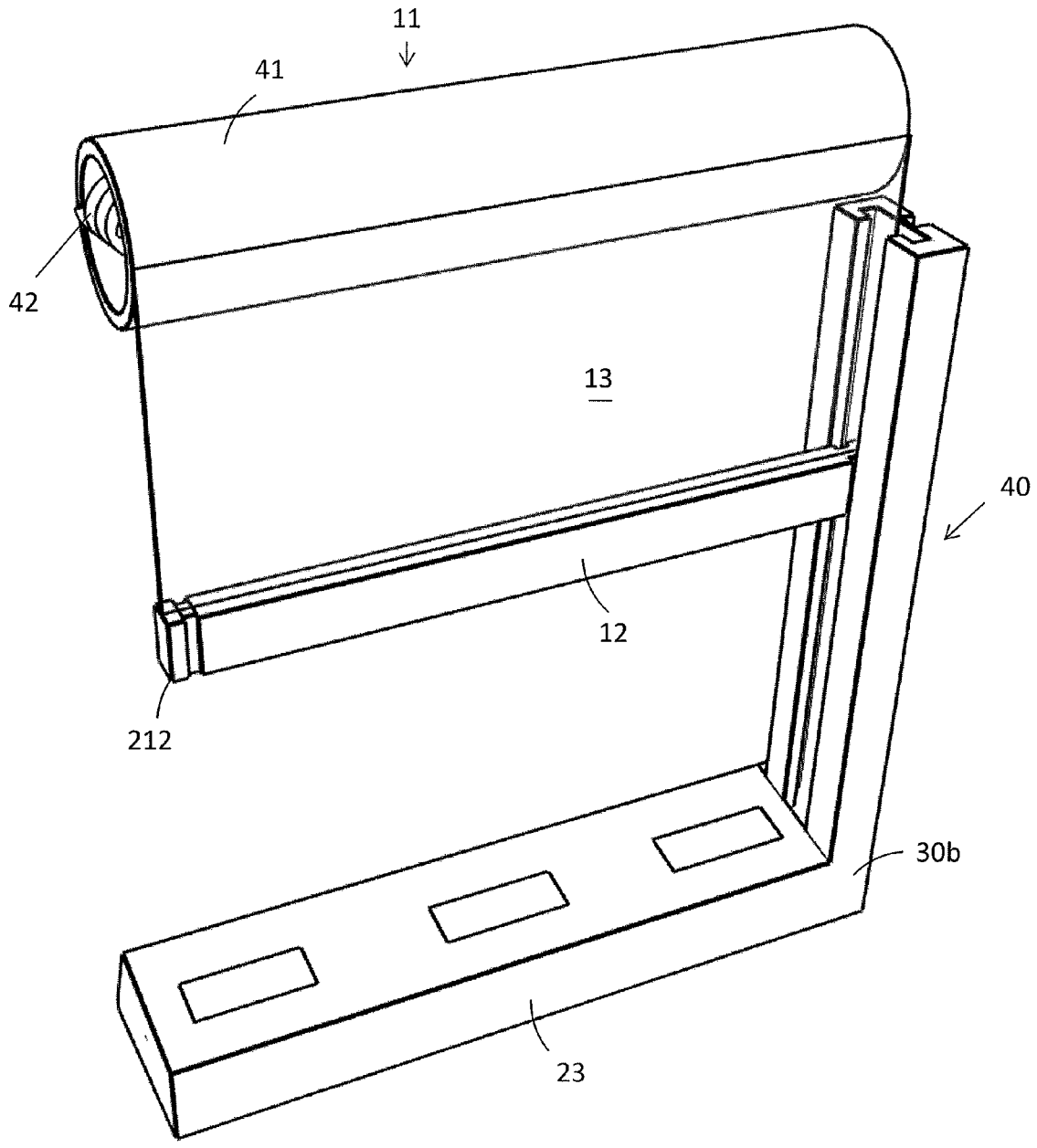

FIG. 1 is a perspective top view of the retractable screen element with housing members, as configured for a first embodiment of the retractable screen element;

FIG. 2 is a perspective bottom view of the retractable screen element of FIG. 1, FIG. 3 is a perspective view from the top of a typical double hung window with the retractable screen element attached to a bottom window sash and shown as being partially pulled down, FIG. 4 is a perspective view from the inside side of a window with a retractable screen element housing member attached to the inside of the bottom sash and with tracks for the screen extension and retraction, FIG. 5 is a partial cutaway showing the interior of the upper housing member of the retractable screen of FIG. 1 installed on a window sash and being pulled down with the side edges configured to be guided in travel through a track on the window jamb.

Figure 6A:
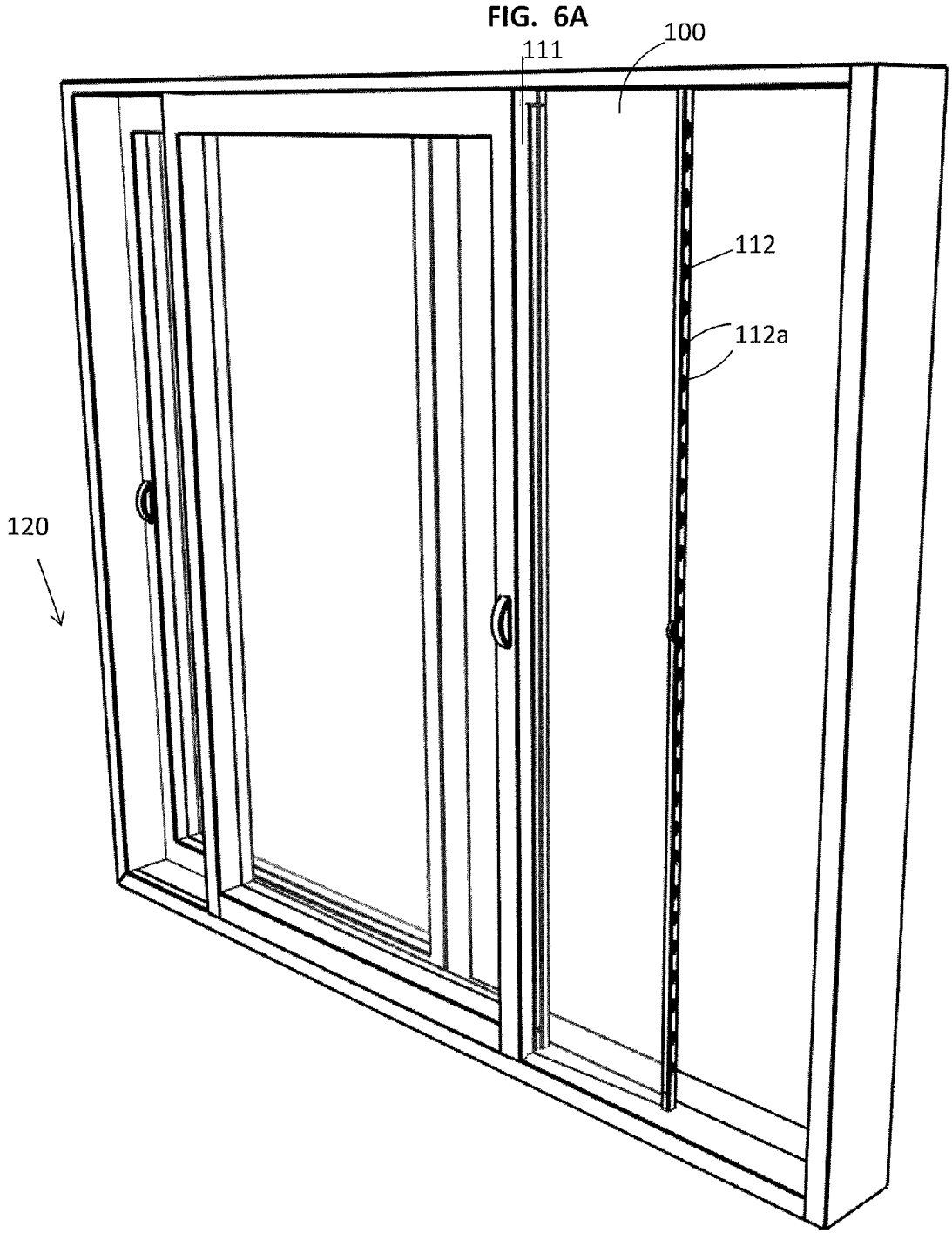
Figure 6B:
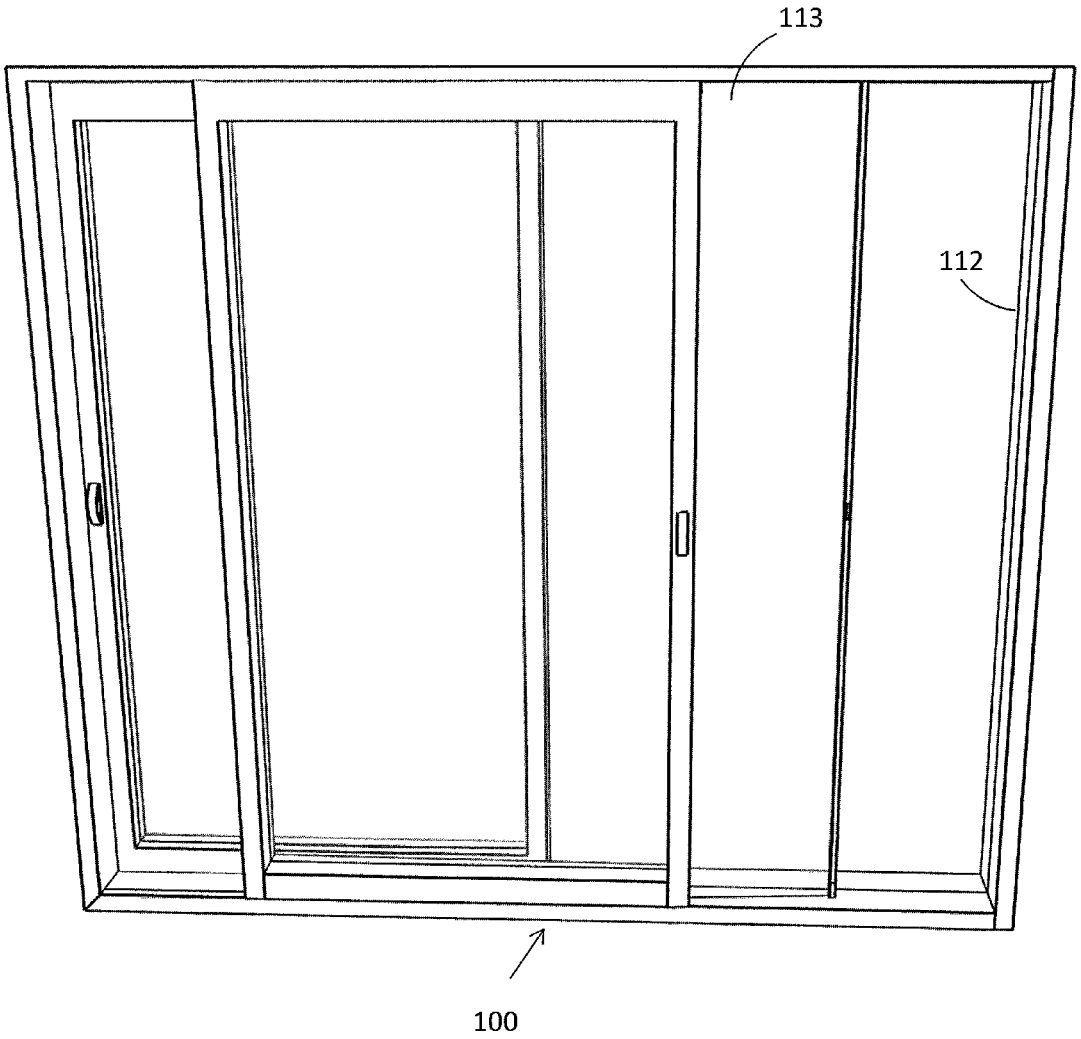
Figure 7:
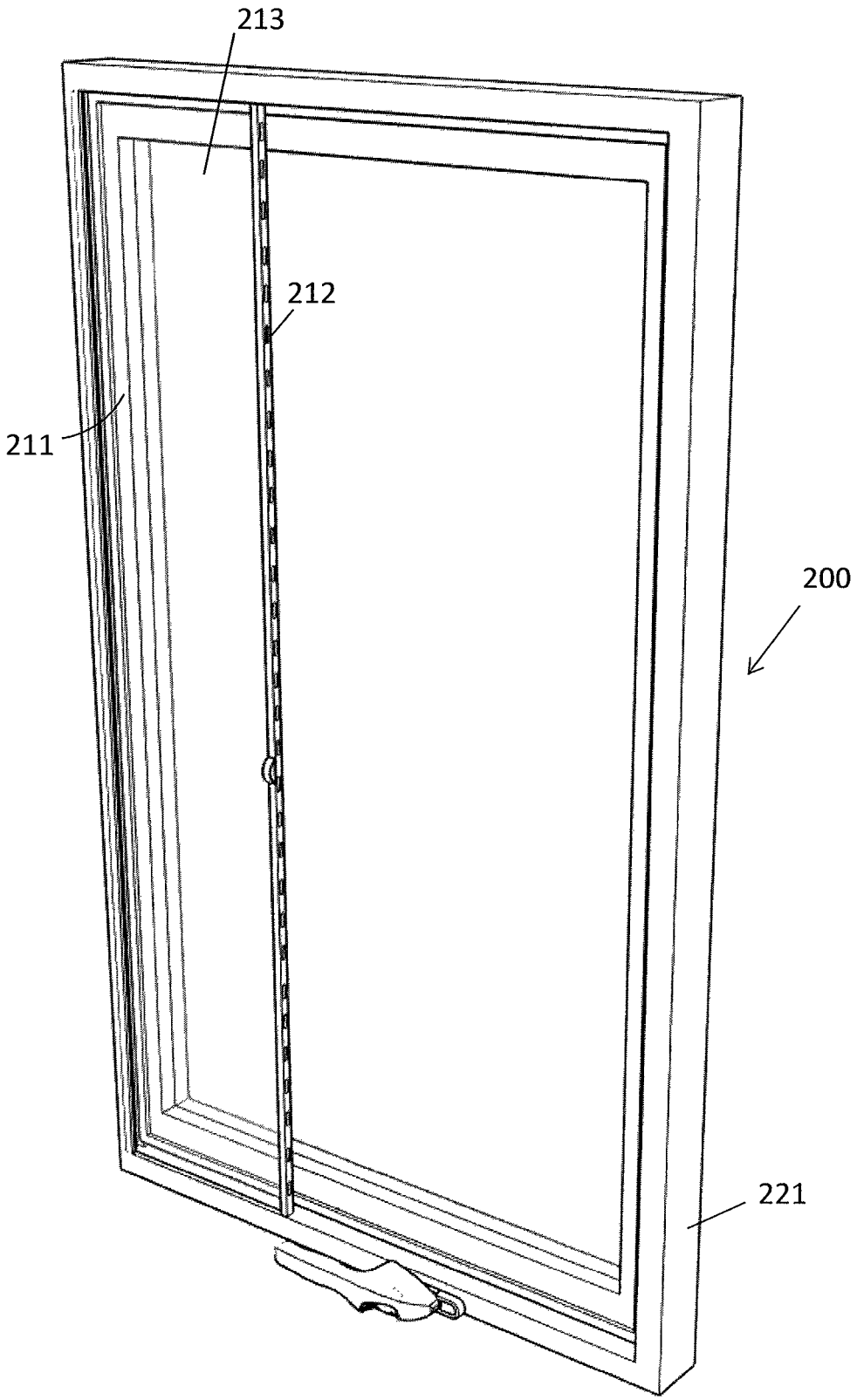
Figure 8:
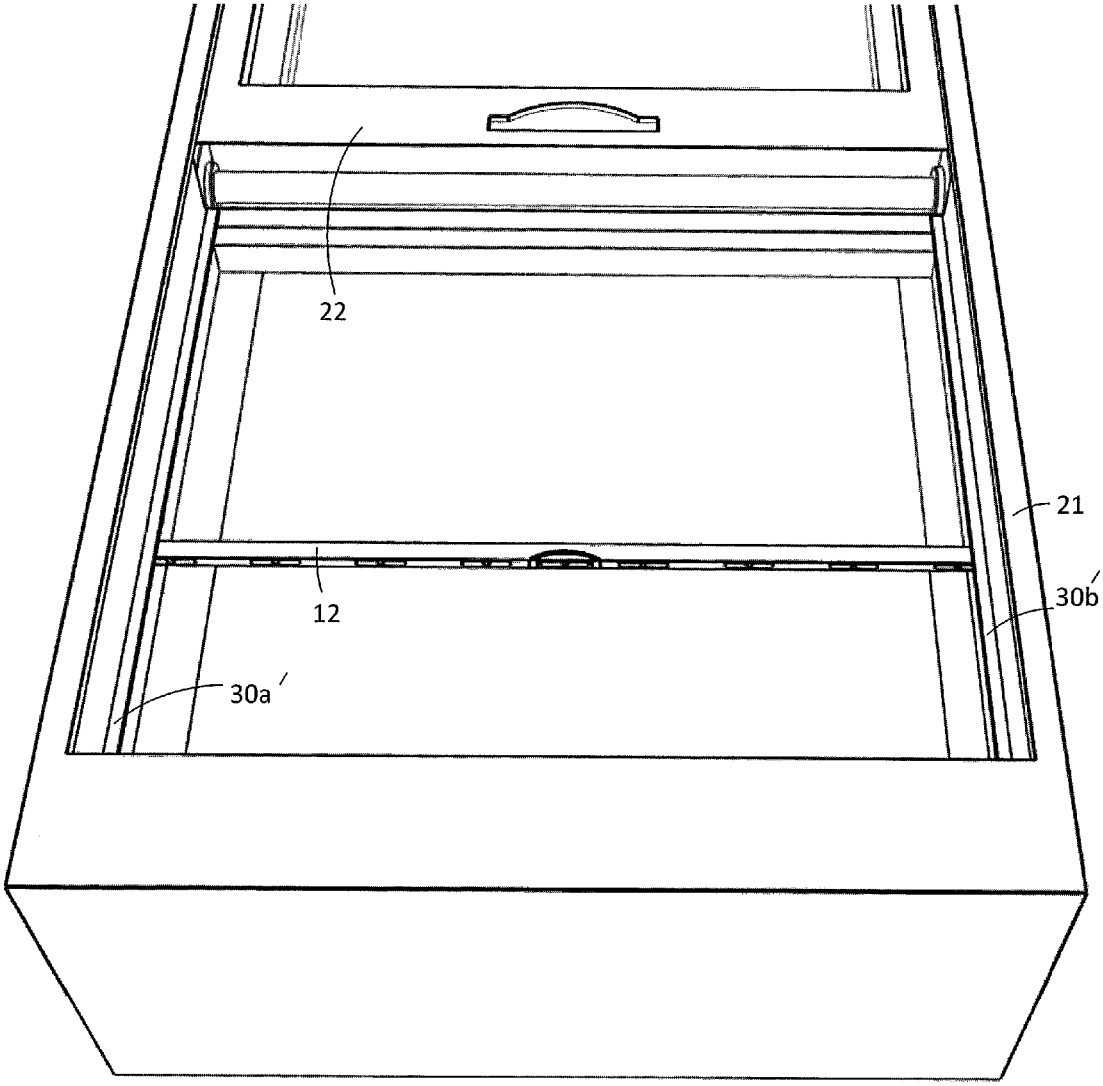
Figure 9:
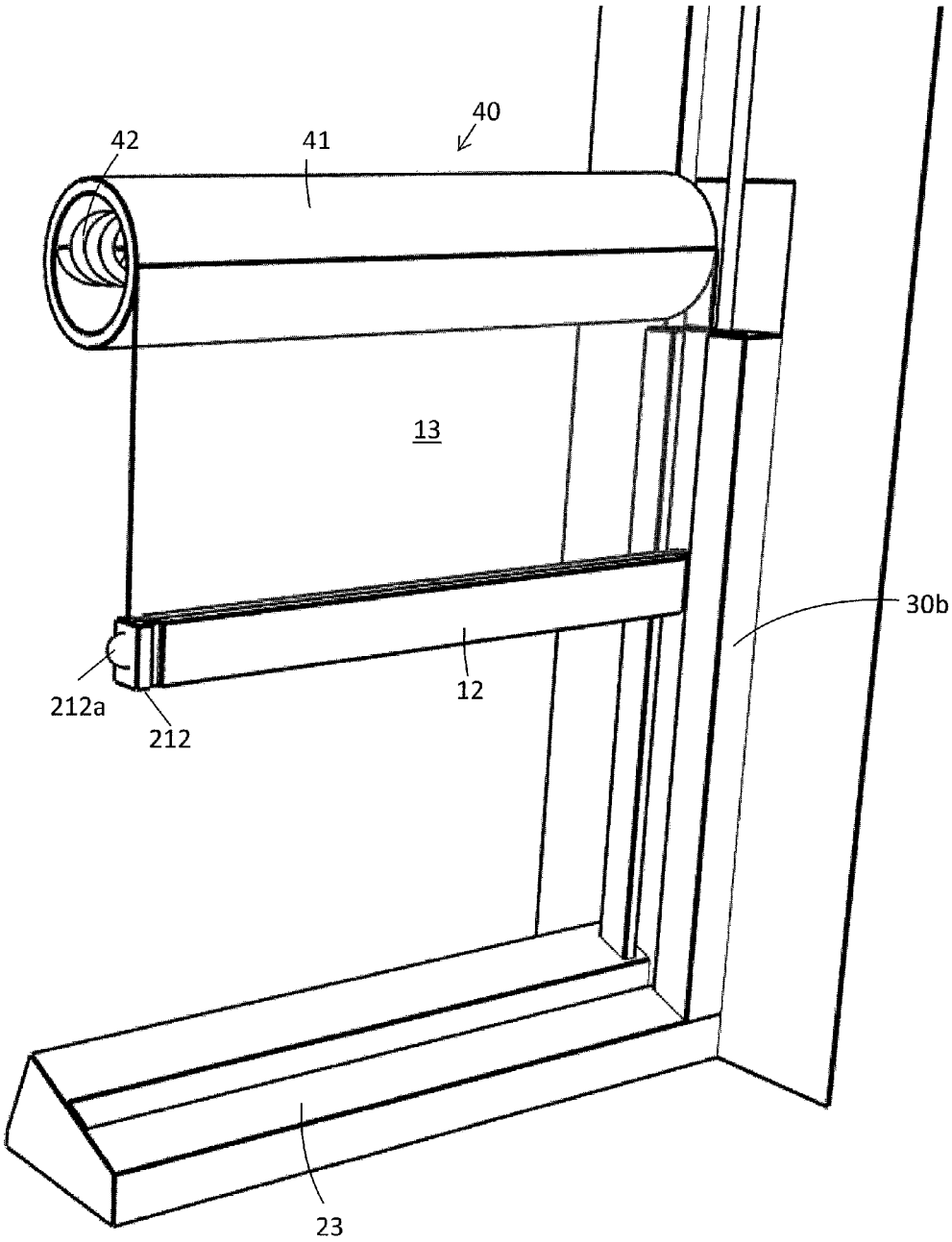
Figure 11A:
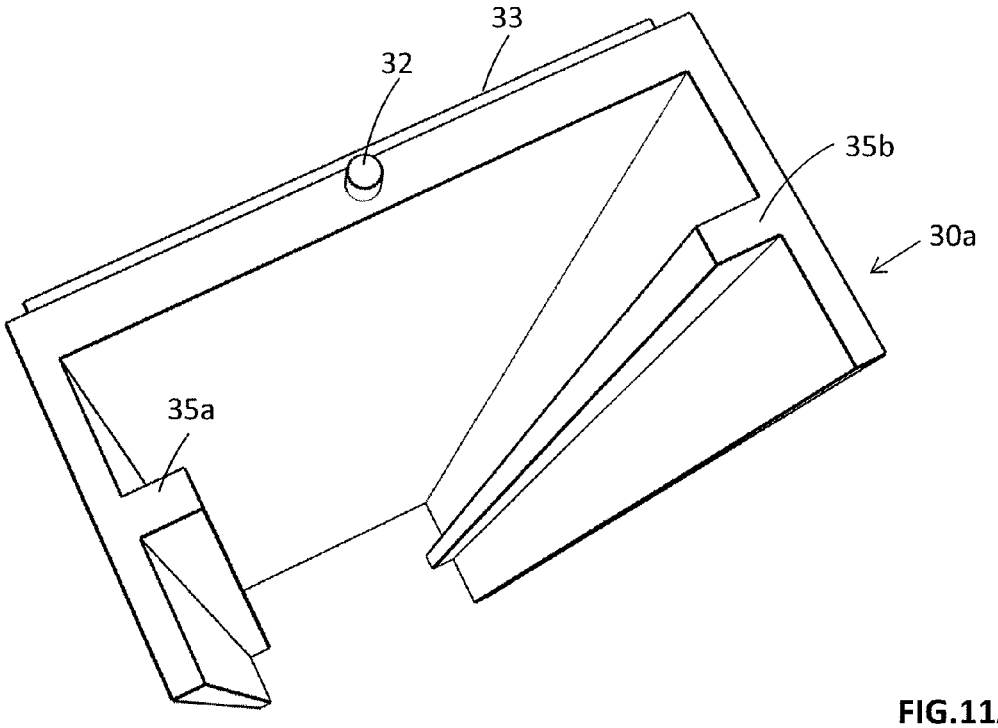
Figure 11B:
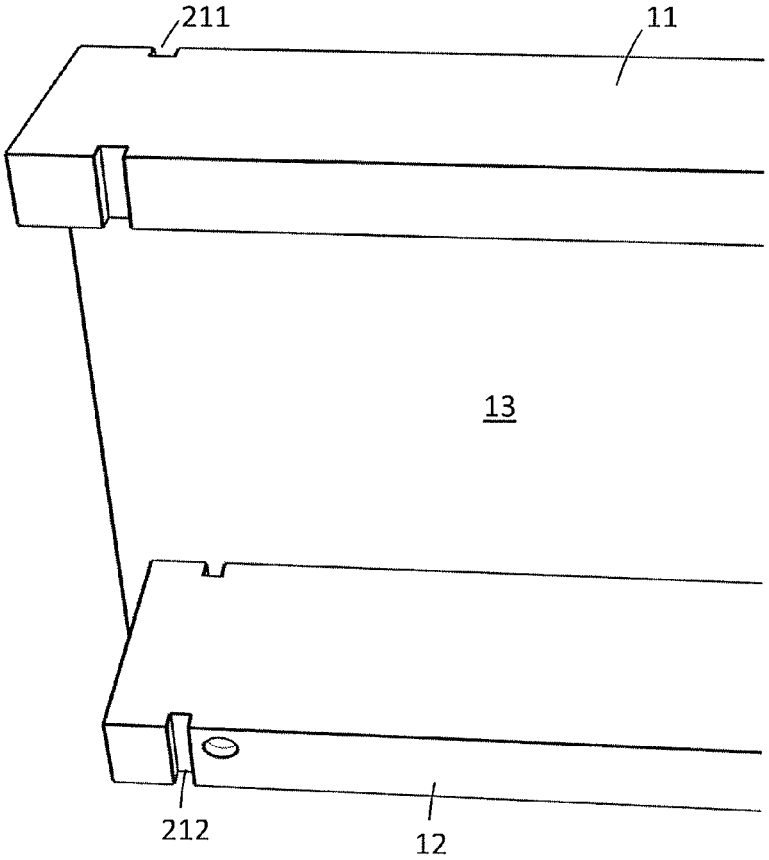
Figure 11C:
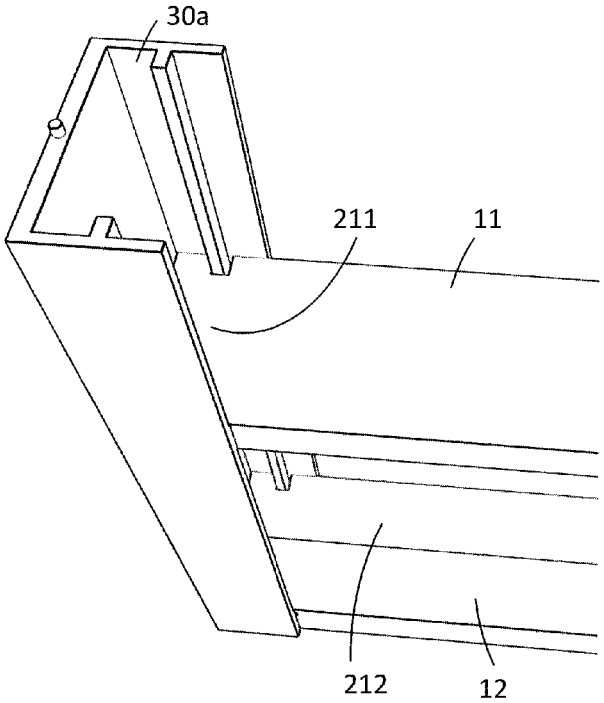
Figure 12:
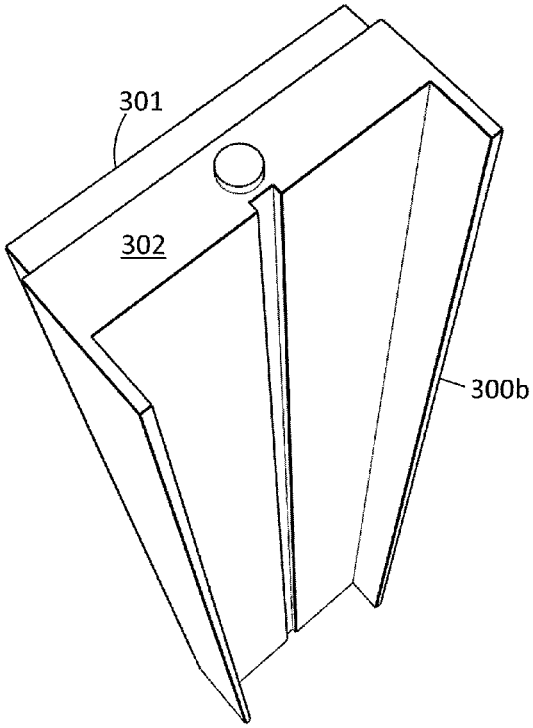
Figure 13A:
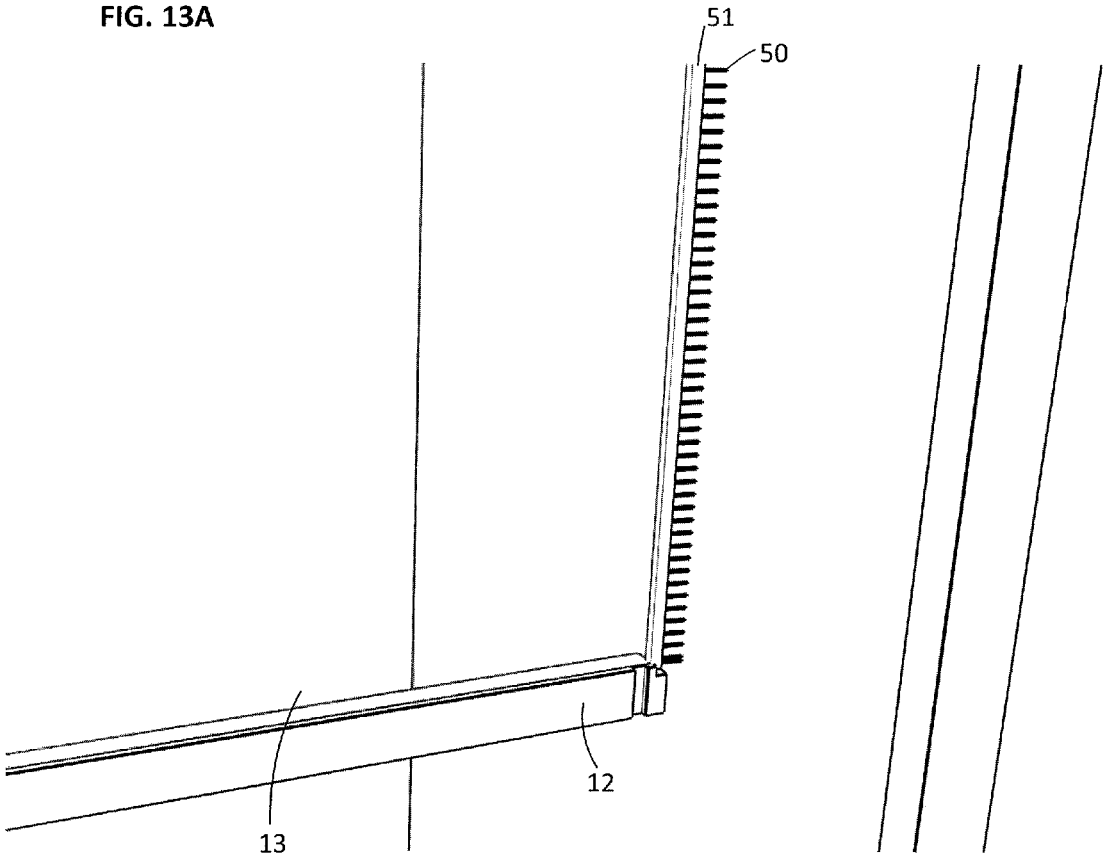
Figure 13B:
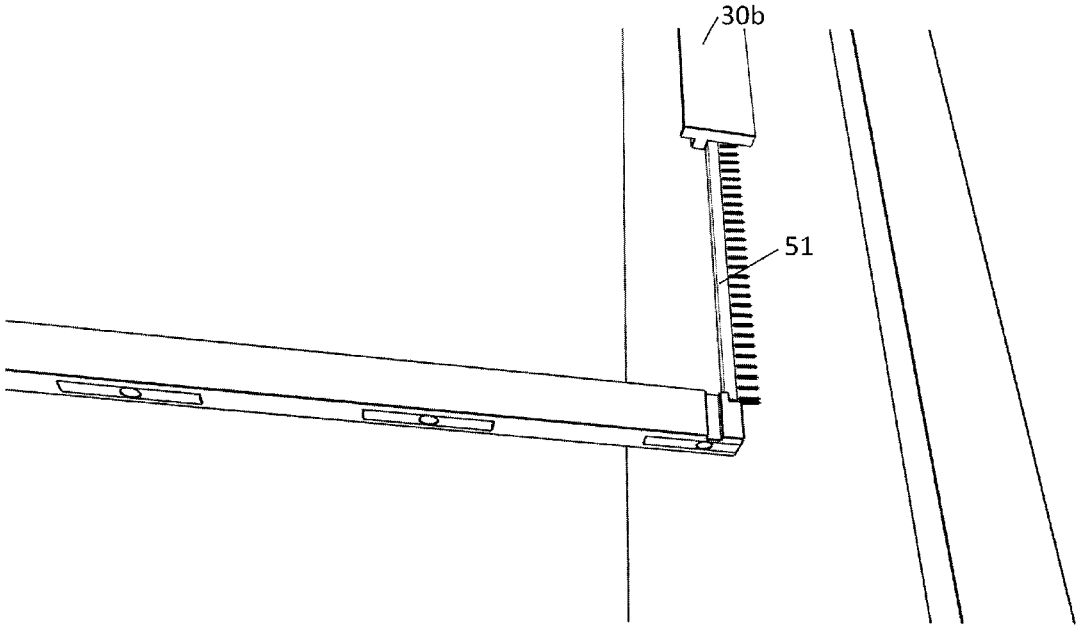
Figure 14:
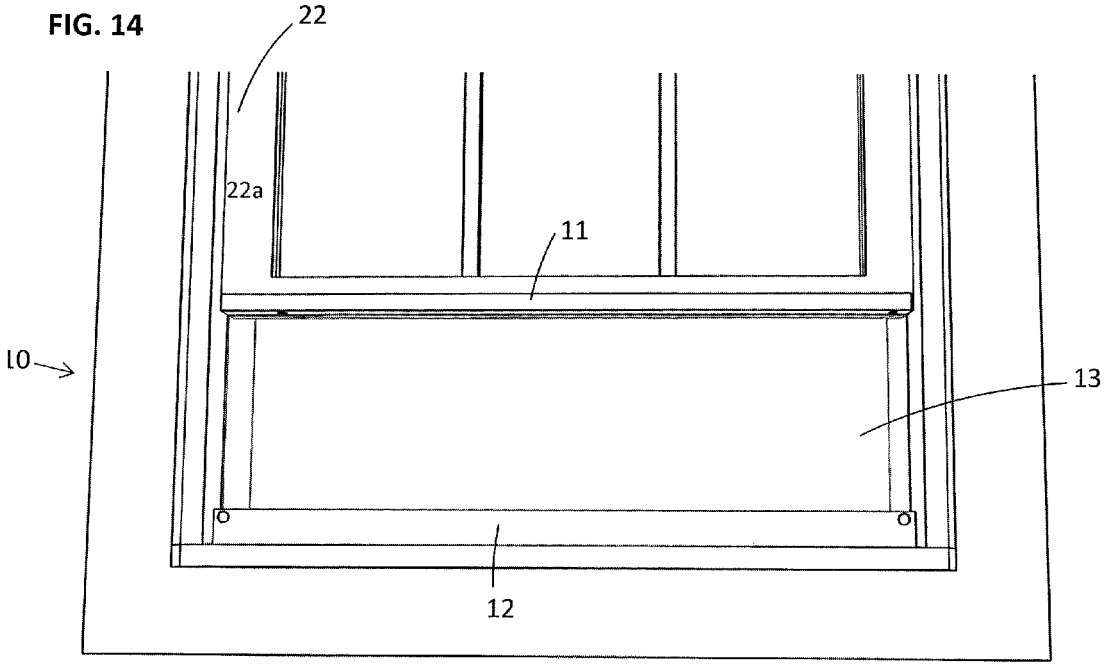
Figure 15A:
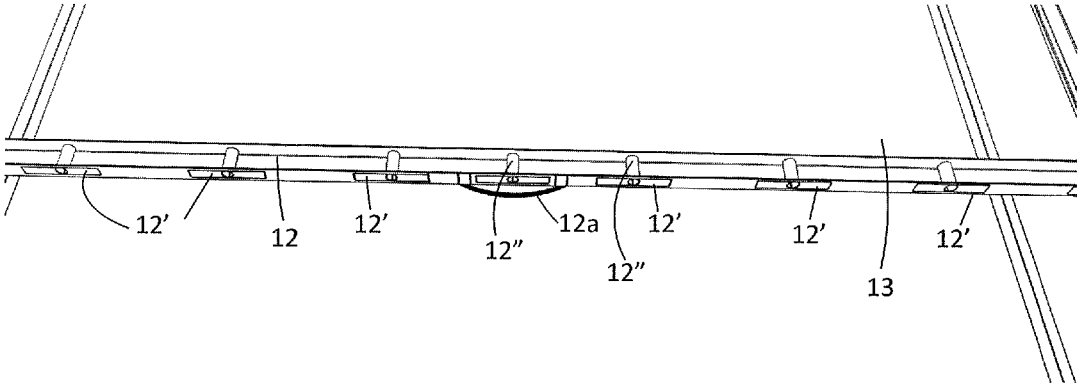
Figure 15B:
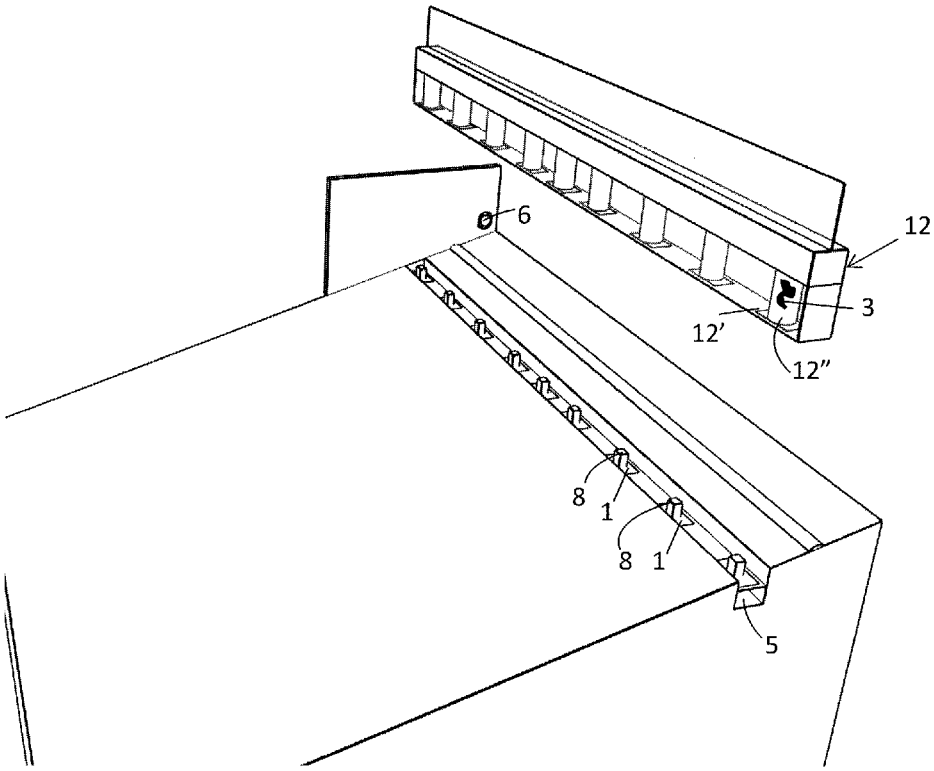

FIG. 6*a* depicts the retractable screen element (as applicable to both a removable and non removable window-integrated structure) as deployed laterally with a sliding window, with holding magnets on the end of the window screen;

FIG. 6*b* depicts the sliding window of FIG. 6*a* with the holding magnets on the window frame, FIG. 7 depicts the retractable screen element built into a window frame for a casement window, FIG. 8 depicts a second embodiment with the window sash itself comprising the housing for the coiled screen and retraction/extension mechanism, FIG. 9 is a view similar to that of FIG. 5, as configured for use with second embodiment of the non-removable retractable screen, FIG. 10*a* shows an adjustable lateral track width mechanism to permit use of the retractable screen with different width windows in the removable first embodiment, FIG. 10*b* depicts the adjustable track of FIG. 10*a* with a track retract or extension control and a Velcro attachment for the window jamb, FIG. 11*a* depicts a track with internal side rail extensions with FIG. 11*b* showing the retractable housings with co-fitting indentations and FIG. 11*c* showing the engagement movement between one track and the retractable housings, FIG. 12 is a second embodiment of a removable expandable track, FIGS. 13*a* and 13*b* depict lateral space filing brushes with no track and as incorporated into a track respectively, FIG. 14 is a view of a window from below showing a removable screen structure as fastened to the bottom of the window sash and without peripheral tracks, and FIGS. 15*a* and 15*b* showing expended and window deployed engagement stop mechanism for the non removable retractable screen embodiment respectively which serves to prevent automatic engagement of the screen structure with a window sill.

DETAILED DESCRIPTION OF THE INVENTION AND DRAWINGS

In operation, and with reference to a window application by way of example, the retractable screen element housings are simply operatively attached to the window by placing hook and eye fasteners, known by the trademark Velcro, magnets or clips on the windowsill and window sash respectively. In a preferred embodiment of the removable screen element embodiment, there is a further installation of lateral (relative to the housings) removable expandable tracks on each side of the window frame. In addition to the tracks providing extra durability, they also serve to permit a removable screen to be a capable of being 'one size fits all' (within several inches of deviation). Each window should preferably however have separate hook and eye or other attachment element positioned on the respective windowsill and window sash.

Once the screen housings, with or without lateral tracks, are attached to the window, the user is able to open and close the window in a normal manner, and the retractable screen automatically follows with the motion of the window sash. The entire retractable screen element can be effortlessly removed when not in use and/or moved to another window if so desired. When one of the housing members is placed behind the window sash (either top or bottom) rather than at the bottom or top edge of the sash, the window is thereby able to be closed and locked. The screen moves up and down with the motion of the window (or laterally with a jalousie or louver window), as a result of the screen being directly attached to the window sash with the screen always being properly opened to cover a formed opening. Positioning of the screen accordingly requires no separate motion apart from the motion involved in opening and closing the window itself. Once the screen is attached to the window, the consumer can open and close the window as usual, and the screen automatically follows with the motion of the window sash. As described, the screen can be used on any double hung, single hung, and sliding window and door as well as crank controlled casement windows (and hinged doors), with the latter having the retractable screen element housings integrated with the window frame on the inside of the window.

In a preferred removable embodiment, which can be utilized with different windows, as desired, the retractable screen element comprises lower and upper housing members preferably of a rigid non-corroding, non-warping plastic material. Either one of lower or upper housing members has the mesh screen mechanism contained therein and the other housing members has the position locking mechanism such as magnets or magnetic elements integrated therein. The mesh screen itself is attached through a small slit in the housing thereof to the position locking housing member whereby when the screen is retracted the respective housing elements are directly juxtapositioned. In a preferred embodiment, a side of the mesh screen mechanism housing is removably attached to the inside or rear of the bottom of the actual window sash such as with Velcro (generally directly on the other side of the window handle). A releasable attachment mechanism, which releasably cooperates with the position locking mechanism is releasable attached to the window sill such as with Velcro. The housings can be reversibly positioned as well, with modification of the locking mechanism.

The retractable screen mechanism is preferably comprised mostly of plastic with metal springs. The main base of the mechanism is comprised of a plastic cylinder with the mesh screen wrapped around it. A compression spring passes through the plastic cylinder, or there may be two constant force springs, one on each side of the cylinder to provide an extension and retraction operation similar to that of common window shades.

It is preferable that on both exposed edges of the mesh screen there are flexible gap closing elements. For example, thin round rubber elements may extend along the entire length of the sides of the mesh screen. Feathery brush elements are mounted on the rubber elements that run along the sides of the screen in place. The brush elements serve to close the gap from the end of the screen to the window or track and to keep anything unwanted out of the inside of the house.

To facilitate placement and/or removal the respective housings are preferably provided with small handles or indentations to provide finger grips and cooperative storing indentations structures for the handles.

An additional preferred component is that of a guide track for the retracting or extending screen to insure proper positioning and to prevent excess wear occasioned by skewed movement. The track provides extra durability and with an expandable and retractable thickness serves provide a "one size fits all" fitment of a single size retractable screen element in window of various slightly different widths. In this regard the tracks are adjustable relative to the width of the housings so that it can be adjusted to fit the size of the window it's installed on. In an operational embodiment the tracks retract or are expandable by pushing down on a small button on top of the track. The tracks are preferably comprised of hard non-corrodible plastic and are removably attached by fasteners such as Velcro to the side jambs of the windows and are placed in parallel pairs to engage with the two ends of the respective housing elements.

For engagement utilization of the tracks the respective housing are provided with peripheral small plastic extensions that extend from the center of the 4 sides of the respective upper and lower housings. The extensions are simply inserted into the respective co-fitting track for upward and downward movement (or sideways for casement or sliding windows) after the tracks have been properly sized on the particular window for engagement with the housing members.

Small indentations on both sides of the housings, about half an inch from the end cooperate with co-fitting indentations in the respective tracks to minimize movement slop for smoother operation and better for durability.

In order to compensate for slanted windowsills, such as are found with Anderson windows, shims of appropriate size may be utilized to square up the generally flat surfaces of the respective housing members which contact the slanted windowsill.

Though Velcro and magnetic attachment have been described, other alternative removable attachments may be similarly utilized such as plastic clips/clamps.

Should the housing member exactly coincide with the window sash dimensions, a track for the retractable screen is not readily feasible and the user has the option of attaching the screen mechanism housing directly to the bottom of the sash. However, it should be noted that such embodiment placement is not as durable and will usually require removal of the housing in order to close and lock the window as a result of the thickness of the housing In a second embodiment of the invention the window sash itself (or window frame) comprises the housing for the retractable screen mechanism with a non-removable integration of the retractable screen mechanism with the window sash and/or frame. Accordingly, such embodiment is provided by the window manufacturer for use with a specific window and is not removable. In such embodiment the mechanism of the screen is placed in the bottom part of the front window sash. Alternatively, the screen can also be placed in both window sashes, if the window manufacturer prefers (for double hung windows). The window screen can be manually or automatically pulled down alongside a track on both sides of the window. It then gets locked into place on the windowsill. The screen gets pulled down and locked into the base by means of various types of locking mechanisms.

With specific reference to the drawings, FIG. 1 depicts the retractable screen element 10 with main or first housing 11 in which the screen retraction mechanism is housed. Smaller second housing 12 includes retention of an end of screen 13 and locking elements 12*b* shown in FIG. 2. The locking elements 12*b* are generically shown and can either be Velcro, magnetic elements or other locking mechanisms. Velcro or magnetic elements 11*b* and the like, on housing 11 serve to hold the main housing in place on a window sash 22 of window 20 at the bottom thereof, as shown in FIGS. 3 and 4. FIG. 4 shows the peripheral sides of extended screen 13 fitted and guided for up and down movement within tracks 30*a* and 30*b* fastened to window frame 21.

FIGS. 5 and 9 depict the screen retraction mechanism 40 with cylinder 41 and contained tensioning spring 42 as contained within housing 11 for both first and second embodiments. FIGS. 5 and 9 differ in relative placement of the first housing with the first housing in FIG. 5 being offset relative to the sill 23 and the track 30*b* because of placement behind the sash.

Screen 13 is coiled within the housing (not shown in FIGS. 5 and 9 for clarity) and tensioned with the spring 42 for retraction and taut deployment as shown in FIG. 4. The end of housing 12 is shown with configured end 212 adapted to fit within a slotted track of track 30*a* (shown in FIG. 11*c*) for guided movement. Button 212*a* shown in FIG. 9 optionally fits with sliding movement within slot 34 shown in FIG. 10*a* for further guided movement, in the non-removable embodiment.

FIGS. 6*a* and 6*b* show the deployment of retractable screen element 100, with housings 111 and 112 and screen 113 as positioned laterally on a sliding window 120. with alternate placement of magnetic locking elements 112*a* and 112*b* respectively. FIG. 7 depicts retractable screen 213 peripherally held within housing members 212 and 211 as integrated within the frame 221 of casement window 200 and locked with magnets 212*b*.

FIG. 8 is an upward view of the second non-removable embodiment with screen 13 extending from the bottom of window sash which functions, as seen in the cutaway, as the first housing as in the first embodiment. Track elements 30*a*' and 30*b*' are non-removably fixed for retraction/extension of screen 13 and housing 12.

FIG. 10*a* shows track 30*a* with internal movable track element 30*c* which is laterally movable therein to closely accommodate the lengths of housings 11 and 12. The lateral movement to provide fitting adjustment is controlled with release button 32. Velcro pad 33 holds the track in place during use and adjustment. FIG. 10*b* shows a maximum width adjustment with the tracks 30*a* and 30*c* being closely fitted with each other.

FIG. 11*a*-11*c* depict a track modification with internal extensions 35*a* and 35*b* configured to fit within the indentations of housing elements 211 and 212.

FIG. 12 depicts a different embodiment of the removable track 300*b* with adjustment capability with solid extension 301 being adjustably movable into a co-fitting interior of the track base 302.

FIGS. 13*a* and 13*b* depict the use of feathery brush 50 on base element 51 at the side of screen 13 to fill any gap because of window size differences and spacing of the screen from the window jambs without tracks in FIG. 13*a* and even with a track as shown in FIG. 13*b*, FIG. 14 depicts a retractable screen element 10, which is dimensionally equal in length to the bottom 22*a* of window sash 22. No tracks are used and housing 11 is connected directly to the bottom of window sash bottom 22*a*, FIG. 15*a* shows an embodiment of the non-removable retractable screen with a lower peripheral edge of housing 12 with magnets 12' being spring loaded with cylinder 12" for holding and facilitated removal of housing 12 from a window sill to provide controlled retraction of screen 13. FIG. 15*b* more clearly show the interaction between spring-loaded magnets of housing 12 and pop up plastic elements 15 for facilitated magnet disengagement.

In the embodiment shown in FIGS. 15A and 15B the second elongated housing member 12 is releasably locked with the cooperative locking element with a releasable magnetic locking. Magnetic locking elements 12' with integral cylinders 12" on the second elongated housing member are spring loaded with springs 3 contained within cylinders 12" whereby extending stud elements 8 within groove 5 of window sill 23 (the sill 23 could similarly be formed without a groove 5) extend into coextensive cylinders 12" to prevent automatic touching locking with prevention of pressure contact. Release of the stud elements 8 into the window sill by activation button 6 enables compressed springs 3 to push the stud elements 8 out of the cylinders 12", thereby permitting the magnetic locking elements 12' of housing member 12 to contact the magnetic periphery 1 of stud elements 8 to thereby magnetically lock the housing to the sill.

It is understood that the above description and drawings are merely illustrative and that changes may be made to structures sand components of the retractable screen structure and the specific utilization thereof without departing from the scope of the present invention as defined in the following claims.

What is claimed is:

1. A retractable screen structure configured for spanning and substantially covering an opening in any one of a window and doorway, the structure comprising:

i) a first elongated housing member having a longitudinal axis, ii) a coiled expandable screen mesh element contained within the first housing member with an end thereof extending out of the first housing member, wherein the first elongated housing member is comprised of one of a sash of the window and an edge of a door adjacent to and movable away from a frame segment of the window or door respectively;

iii) a second elongated housing member having a releasable position locking element and positioned substantially parallel to the first housing member and integrated with the frame section of the window or door respectively and connected to the extended end of the screen mesh element, and iv) a cooperative releasable locking element positioned on one of the door frame or window frame, which is configured to cooperate with the releasable position locking element of the second elongated housing member to effect a releasable locking therewith, wherein the coiled screen mesh element comprises an elongated coiled roll of sufficient width and length to freely span and substantially cover the opening when uncoiled, the coiled screen mesh element being connected to a spring loaded retracting and extending mechanism contained within the first housing member, with the retracting and extending mechanism configured to allow the end of the screen mesh element to be drawn through an opening in the first housing member and uncoiled to substantially cover the opening and to unimpededly retract the screen mesh element when desired, with activation of the spring in the spring loaded mechanism, wherein only the end of the screen mesh element extending through the opening is fixedly engaged with the second elongated housing member, or the window or door frame to thereby permit the unimpeded retraction of the screen when the fixed engagement of the end of the screen mesh element is released wherein a screen covering of an opening is formed with extension of the screen mesh element to cover the opening, wherein the second elongated housing member is releasably locked with the cooperative locking element with a releasable magnetic locking and wherein magnetic locking elements on the second elongated housing member are spring loaded and whereby extending stud elements prevent automatic touching locking without pressure contact.

2. A window having a retractable screen structure integrated therewithin, wherein the window comprises:

i) a window frame, comprising opposing side sections with at least one pair of longitudinal channels in the opposing sides respectively, and at least one of a bottom sill portion with a sill trough section, and a head with a head trough section, and ii) at least one window sash comprised of opposing side members and upper and lower end rails, wherein the opposing side members of the window sash are slidably movable within one pair of opposing channels of the window frame respectively, with such slidable movement effecting opening and closing of the window, with the end rails being moved away from and toward abutting engagement thereof with a trough section in a sill or head of the window frame, to provide such opening and closing of the window respectively, with the formation of an opening through the window and the closing of the opening, wherein an end rail of the sash contains a coiled spring loaded expandable screen element having a screen with a first end thereof contained within the end rail, and with a second end of the screen extending out of a longitudinal opening in the end rail which directly faces a surface of the trough section of either the sill or head with which the end rail is abutting engaged when the window is closed, and the second end of the screen being engaged to a longitudinally elongated carrier element coextensively positioned with the end rail between the end rail and the trough section abutting surface, the structure further including a pair of track guide elements positioned within the pair of opposing channels respectively, the respective track elements extending from the window trough to a position adjacent the window rail when the window is fully opened, wherein opposite ends of the elongated carrier element are configured to adjacently engage the respective track guide elements, whereby movement of the carrier element along the track guides provides extension and retraction of the screen element in a direction substantially coextensive with the window sash, wherein the opposing side members of the window sash are configured to accommodate the respective track elements therein to permit the slidable movement of the opposing side members in the respective channels for opening and closing of the window, and wherein the elongated carrier element comprises releasable engaging and position locking elements on a portion thereof directly facing a surface of the window trough to which the end rail is abutted and wherein the abutting surface of the window trough is provided with cooperative releasable engaging and position locking elements for engagement with the engaging and position locking elements of the carrier element, with the engaging and position locking elements being of sufficient holding strength to maintain the engagement against retraction force of the coiled spring loaded expandable screen element to provide a screen covering of the opening and wherein the engagement is manually releasable, if desired, whereby the carrier element is held adjacent to the end rail by the retraction force of the coiled spring loaded expandable screen element whereby the opening of the window has no screen obstruction thereover.

3. The window having a retractable screen structure of claim 2, wherein the window is selected from the group consisting of single hung window, double hung window and sliding window.

4. The window having a retractable screen structure of claim 2, wherein the carrier element is provided with a manual grip element configured to permit disengagement of the carrier element from a releasable engagement with the engaging and position locking elements whereby the screen element is automatically or manually retracted into the housing member and removal of the screen element from covering the opening and wherein the manual grip element is configured to permit manual movement of the carrier element from the housing and to effect screen element extension.

5. The window having a retractable screen structure of claim 2, wherein releasable fastening of the carrier element is configured to be effected by at least one of magnetic, hook and eye, and engaging clip elements.

6. The window having a retractable screen structure of claim 2, wherein lateral edges of the screen element are provided with brush elements which are configured to cover any gap between the free lateral edges of the screen element and the window frame when an opening is formed.

7. The window having a retractable screen structure of claim 2, wherein the end rail of the window is configured to fully contain the carrier element therein when the screen element is fully coiled whereby the window end rail can be in full closed contact with the adjacent window trough.

8. The window having a retractable screen structure of claim 7, wherein the carrier element comprises a laterally outwardly extending handle member configured to permit the carrier element to be drawn out of the window end rail and for extending the screen mesh from the end rail.

9. The window with a retractable screen structure of claim 2, wherein terminal ends of the carrier element are configured to fit into and move within the track guide elements without connection thereto, to guide movement of the screen element.

10. A retractable screen structure for releasable attachment to a window, wherein the window comprises a window frame having a window sash which has opposing side members and a pair of longitudinal end rails, wherein the opposing side members of the window sash are slidably movable within a pair of opposing channels of the window frame, with such slidable movement effecting opening and closing of the window, with the longitudinal end rails being moved away from and toward abutting engagement thereof with a trough section in a sill or head of the window frame, to provide such opening and closing of the window respectively, with the formation of an opening through the window and the closing of the opening, wherein the retractable screen structure comprises an elongated longitudinal housing of a length substantially the same as the longitudinal length of the end rail, the housing comprising releasable adhering elements on an outer surface thereof configured to provide releasable adhering connection to a surface of one longitudinal end rail of the window which surface faces away from the window, the housing containing a coiled spring loaded expandable screen element having a screen, with a first end of the screen contained within the housing, and a second end of the screen extending out of a longitudinal opening in the housing which directly faces a surface of the sill or head adjacent the trough section in the sill or head, when the housing is adheringly connected to the end rail, and the second end of the screen being engaged to a longitudinally elongated carrier element coextensively positioned with the housing between the housing and the facing surface of the sill or head, the retractable screen structure further including a pair of track guide elements configured to be releasably positioned on opposite sides of the window frame in a position between the housing and the facing surface of the sill or head and extending in a direction parallel to the channels of the window frame, the respective track elements extending from a position adjacent the window rail when the window is fully opened to the facing surface of the sill or head, and wherein opposite ends of the elongated carrier element are configured to adjacently engage the respective track guide elements, whereby movement of the carrier element along the track guides provides extension and retraction of the screen element in a direction substantially coextensively parallel to the window sash, with movement of the window sash, and wherein the elongated carrier element comprises releasable engaging and position locking elements on a portion thereof directly facing the facing surface of the sill or head and wherein the facing surface of the sill or head is provided with cooperative releasable engaging and position locking elements for engagement with the engaging and position locking elements of the carrier element, with the engaging and position locking elements being of sufficient holding strength to maintain the engagement against retraction force of the coiled spring loaded expandable screen element to provide a screen covering of the opening and wherein the engagement is manually releasable, if desired, whereby the carrier element is held adjacent to the housing by the retraction force of the coiled spring loaded expandable screen element whereby the opening of the window has no screen obstruction thereover, and wherein the adhering connection between the housing and the end rail is of sufficient strength to prevent unintended removal of the housing from the end rail with movement of the window.

11. The retractable screen structure of claim 10, wherein the track guide elements are configured to be removed and releasably attached to a different window and wherein the elongated housing, releasably integrated with the window end rail, is removable therefrom for attachment to a window end rail of the different window and wherein a sill or head of the different window is provided with the releasable engaging and position cooperative locking elements to provide releasable locking with the elongated carrier element when the screen element is extended to cover an opening of the different window.

12. The retractable screen structure of claim 11, wherein the track guide elements are adjustable to the dimensions of the different window and to permit engagement with terminal ends of the housing and carrier element.

13. The retractable screen structure of claim 12, wherein the track guide elements are configured to be adjustable to be extended away from the opposite sides of the window frame to permit operative engagement with the terminal ends of the housing and carrier element.

14. The retractable screen structure of claim 10, wherein releasable fastening of the housing and carrier element respectively is configured to be effected by at least one of magnetic, hook and eye, and engaging clip elements.

15. The retractable screen structure of claim 10, wherein lateral edges of the screen element are provided with brush elements which are configured to cover any gap between the free lateral edges of the screen element and the window frame when an opening is formed.

* * * * *